United States Patent [19]

Terrien et al.

[11] 4,411,037

[45] Oct. 25, 1983

[54] AUTOMATIC DEVICE FOR LAP JOINT CONNECTION ON THE INTRADOS OR EXTRADOS OF TWO BRIDGE ELEMENTS AND METHOD FOR THE CARRYING OUT THEREOF

[75] Inventors: Michel E. Terrien; Claude Bouvet, both of Angers, France

[73] Assignee: Etat Francais, Paris, France

[21] Appl. No.: 291,452

[22] Filed: Aug. 10, 1981

[30] Foreign Application Priority Data

Jul. 28, 1980 [FR] France ..... 80 18255

[51] Int. Cl.[3] ..... E01D 15/14; E01D 15/12

[52] U.S. Cl. ..... 14/2.6; 14/71.3; 14/27

[58] Field of Search ..... 14/2.4, 27, 14, 71.3, 14/71.1; 52/584

[56] References Cited

U.S. PATENT DOCUMENTS

| | | | |
|---|---|---|---|
| 3,010,128 | 11/1961 | Gillois | 14/27 X |
| 3,208,086 | 9/1965 | Gillois | 14/27 X |
| 3,499,179 | 3/1970 | Weld | 14/27 |
| 3,871,045 | 3/1975 | Bouvet | 14/2.4 |

FOREIGN PATENT DOCUMENTS

| | | | |
|---|---|---|---|
| 2908380 | 9/1980 | Fed. Rep. of Germany | 14/2.4 |
| 135098 | 6/1977 | U.S.S.R. | 14/2.4 |

*Primary Examiner*—Nile C. Byers, Jr.

*Attorney, Agent, or Firm*—Parkhurst & Oliff

[57] ABSTRACT

The present invention relates to means for lap joint connection of two bridge elements to each other on extrados and intrados. Each bridge element comprises at least one flap (2) on the extrados and one flap (3) on the intrados, a means (6, 9, 10) for the combined displacement of the extrados and intrados flaps and means (16, 18) for locking the first of these flaps on the first bridge element and the second flap on the second element to be connected. This invention may be used to bridge gaps of all lengths.

16 Claims, 8 Drawing Figures

AUTOMATIC DEVICE FOR LAP JOINT CONNECTION ON THE INTRADOS OR EXTRADOS OF TWO BRIDGE ELEMENTS AND METHOD FOR THE CARRYING OUT THEREOF

The present invention lies within the technical field of fixed or floating bridges, and more precisely, of means for connecting two bridge elements to each other.

Numerous arrangements have already been proposed in this field. French Pat. No. 2 158 618 discloses a device for the lap assembling of two bridge elements, that is to say a an assembly in which the two elements to be assembled are superimposed at their ends. This device comprises a ball suspended from a tackle chain in order to assemble the two elements, and fixed protruding spherical centering pins engaging funnels. The locking is effected by an annexed set of hooks actuated by jacks.

The primary function of this device is to pick up and deposit a bridge element, and it requires manual labor in order to put the grasping balls in place. In certain useages, the non-effacing centering pins may be subjected to damage.

German Pat. No. 1 124 383 describes a device for assembling two bridge elements end to end which requires manual operation in order to put the locking hooks in place.

Other devices used on bridging equipment are also known.

However, all these devices, depending on their type, comprise straps, yokes, and hooks or mechanical or hydraulic spindles which serve both as assembler and as interlocker.

These devices are not always protected from dirt and are at times subjected to extensive damage due to vehicle traffic. These problems make the unlocking and disassembling operations of the bridge elements difficult. Furthermore, most of these devices are put in place manually, although some of them are semi-automatic.

One of the objects of the present invention is to provide an engagement device which makes it possible to maintain bridge elements assembled and locked to each other (so-called lap assembly) Bridge elements such as walkways, beams, joists and ramps are extended from fixed or floating supports so as to construct a structure which makes it possible for vehicles to pass over any type of gap, while avoiding the drawbacks inherent in the previous arrangements.

Another object of the invention is to reduce the time required in order to place a bridge in use. This is accomplished by installing an automatic interlock after assembly.

Another object of the invention is to assure continuity of the roadway formed by the different assembled elements as well as to permit the assembly assembling of completely identical elements without particularization.

Another object of the invention is to permit lap assembling, that is to say, assembling by superimposing the ends of the elements either on the extrados of an element or on its intrados, depending on the circumstances, and to do this without having to modify or adapt each element in accordance with the position selected.

The object of the invention is therefore an automatic device for permitting the lap engagement of two bridge elements either on the intrados or on the extrados, comprising on each end of each bridge element, in the combination, at least one flap on the extrados of the element, means for the combined displacement of the intrados and extrados flaps, and means for locking the first flap on the first bridge element and the second flap on the second bridge element. In accordance with the invention, the intrados and extrados flaps are arranged on each bridge element at an equal distance from the front part of the element, determining between this front part and their position a free end of the element, the free end of each of the two elements to be assembled coming into overlapping position, the extrados of the one against the intrados of the other.

In accordance with other characteristics of the invention, the means for the joint displacement of the two flaps of one element is formed of a hydraulic jack. The body of the jack is fastened to the inner part of one of the two flaps and an arm of the jack is articulated on the front part of each of the two flaps by means of two rods. The locking means is formed on the first bridge element by at least one pair of bolts controlled by any suitable means such as electric, electromagnetic or hydraulic means arranged on each flap of the first element and engaging in corresponding yokes of the second bridge element so as to cause the flaps to participate in the inertia of the bridge element, in particular by the interlockings of two flaps located on the stretched or compressed fibers of the element under load, whether this be for an element used by itself or one assembled to another element.

Another object of the invention is a method for the automatic lap assembling of two bridge elements, the steps of which are as follows:

the flaps of two bridge elements in accordance with the invention are opened;

the two bridge elements are overlapped so that the guide pins of the extrados flap of the first element (and respectively of the intrados flap of the second element) come into hollow recesses in the front part of the free end of the second element (and of the first element respectively).

the flaps of each element are tightened by means of their displacement jacks and the locking bolts of each flap are actuated.

Other characteristics of the invention will be described in the following description and in the accompanying sheets of drawings which show one non-limitative embodiment of the invention.

FIG. 7 shows a front view in section of the two assembled and locked elements while

Figure 1:
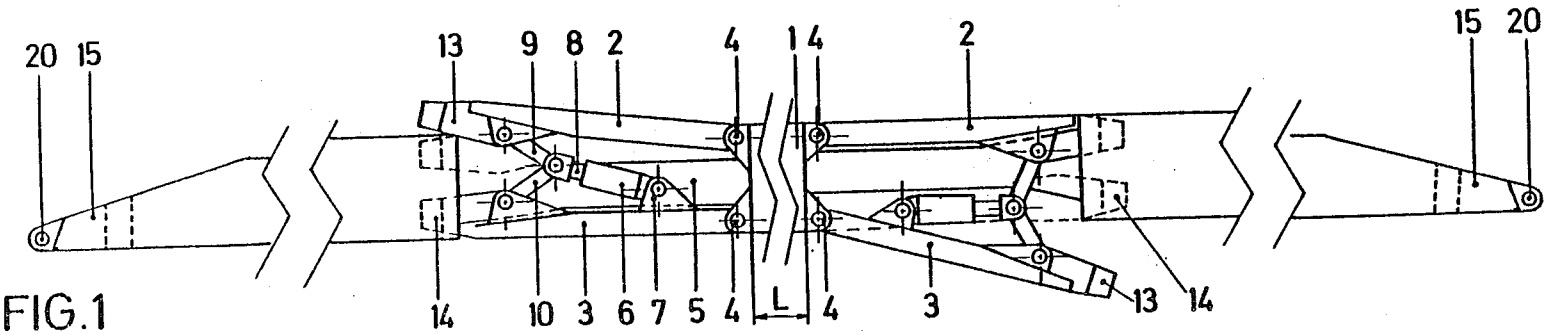
FIG. 1 shows, in side view, a bridge element in accordance with the invention, whose central portion as well as its free ends have been broken apart so as to show the means of the invention on a sufficiently large scale.
Figure 4:
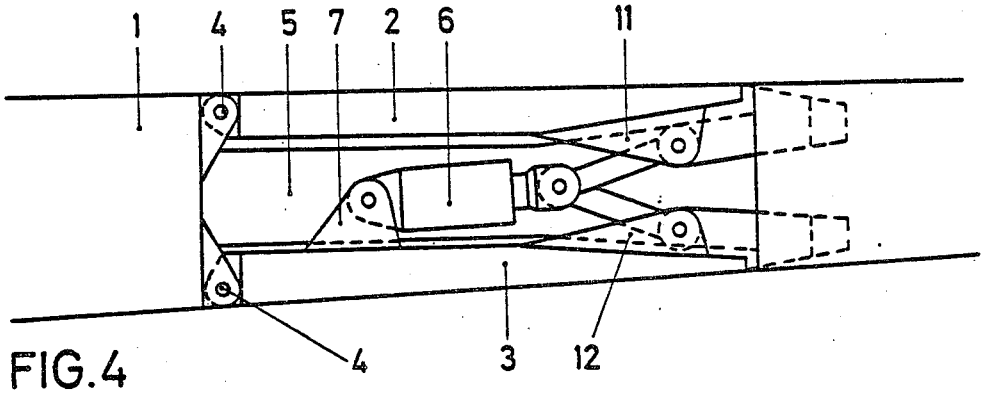
FIG. 4 shows, in side view, the intrados and extrados flaps in closed position.

As has been shown in FIG. 1, a bridge element 1 in accordance with the invention has symmetrically, near each of its two ends an assembly consisting of two flaps 2 and 3 the first 2 being located on the extrados of the element and the second 3 on the intrados. Each flap is hinged at 4 on the element 1 in such a manner that it opens with respect to the end of the element on which it is arranged. The flaps are located at a thinned portion 5 of the element so that, at rest, their outer surface lies within the profile of the element without having any protruding part, as can be noted from FIG. 4. The flaps are made movable by means of a hydraulic jack 6 whose body is fastened (but mobile in rotation) with a yoke 7 on one of the two flaps. In the example shown, the body of the jack is hinged on the intrados flap 3 without this constituting a limitation on the invention. The arm 8 of the jack is connected with two rods 9 and 10 mounted for free rotation on yokes 11 and 12 of the extrados and intrados flaps.

Figure 5:
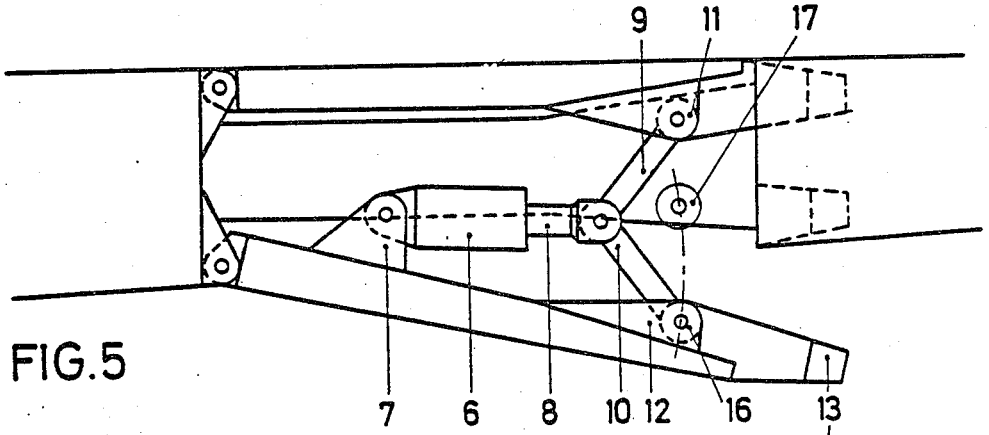
FIGS. 5 and 6 show the same flaps in two other positions, namely extrados flap open in the case of FIG. 5 and intrados flap open in the case of FIG. 6.
Figure 6:
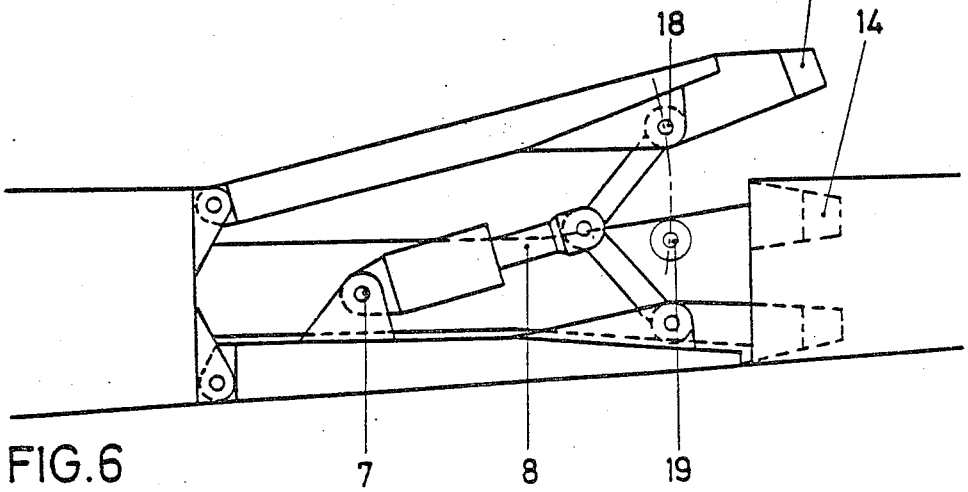
Figure 7:
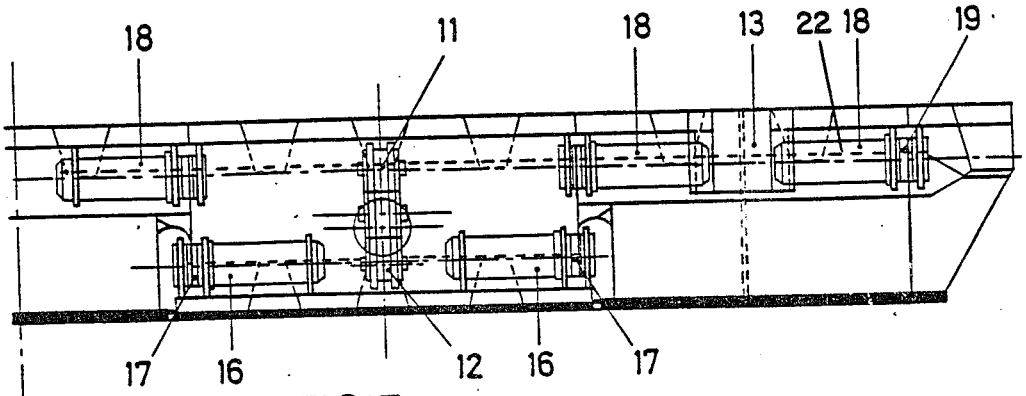
Figure 8:
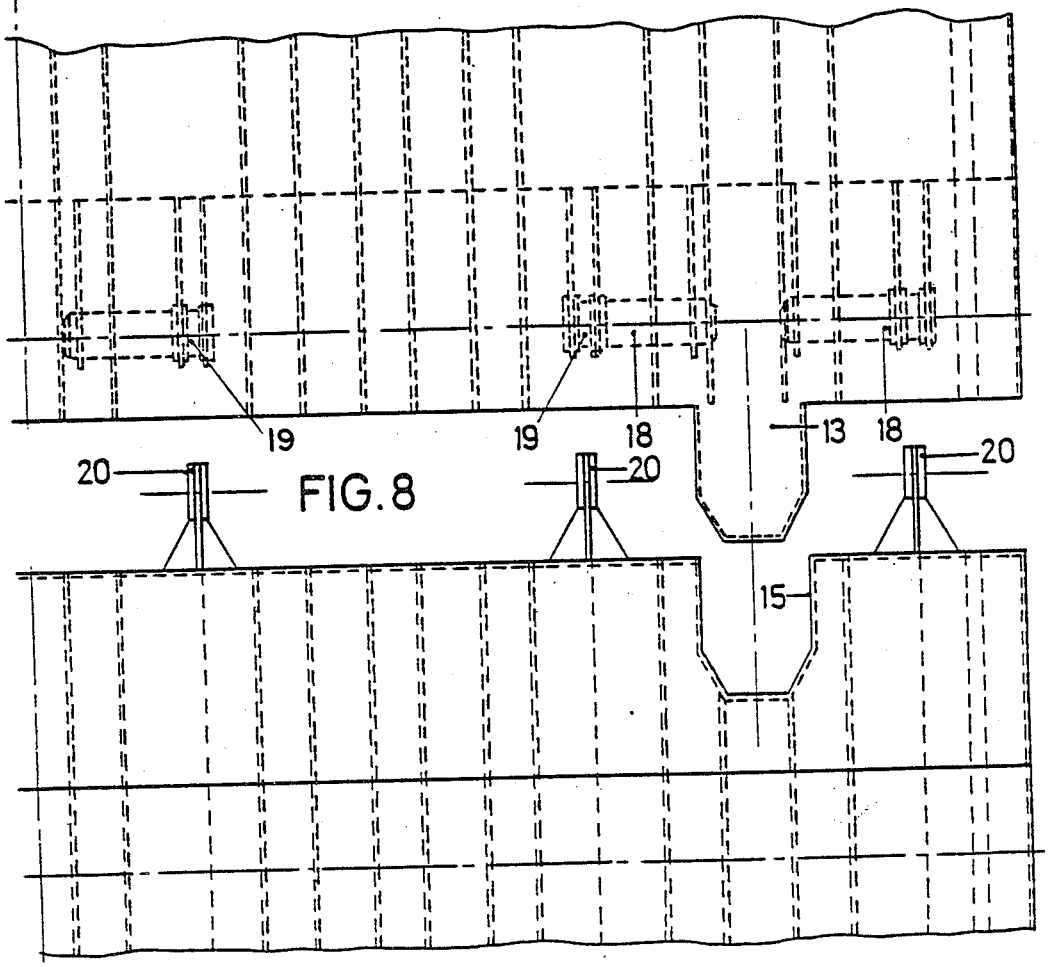
FIG. 8 shows a top view of these two elements before assembling and locking.

The flaps 2 and 3 have centering pins 13 (more clearly visible in FIGS. 5, 6 and 8) which, at rest, lie within hollow recesses 14 located on the element opposite the front face of the flaps, and, during the course of the assembling, may lie within recesses 15 (FIGS. 1 to 3 and 8) provided in the front portion of the free end of the element.

The flaps 2 and 3 can be held in position by a locking means consisting of bolts borne by the flaps and having a locking finger, the flaps being controlled in any suitable manner and coming into position in bored yokes of the bridge element.

Thus, bolts 16 are disposed on the intrados flap and are adapted to engage in boreholes 17 provided in the thinned portion 5 of the element.

Likewise, bolts 18 are borne by the extrados flap 2 and cooperate with boreholes 19 of the element.

Furthermore, the ends of each element have bored yokes 20 within which there engage, after assembly, either the bolts of the intrados flap or those of the extrados flap depending on the selection of the assembling which has been effected.

Figure 2:
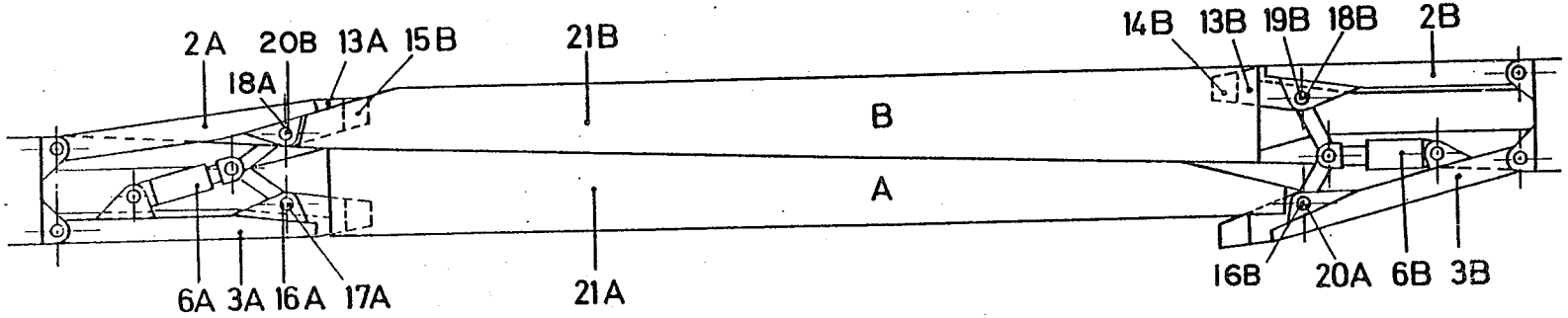
FIG. 2 shows, in side view, the free ends of two bridge elements according to the invention assembled in a first configuration permitted by the invention.
Figure 3:
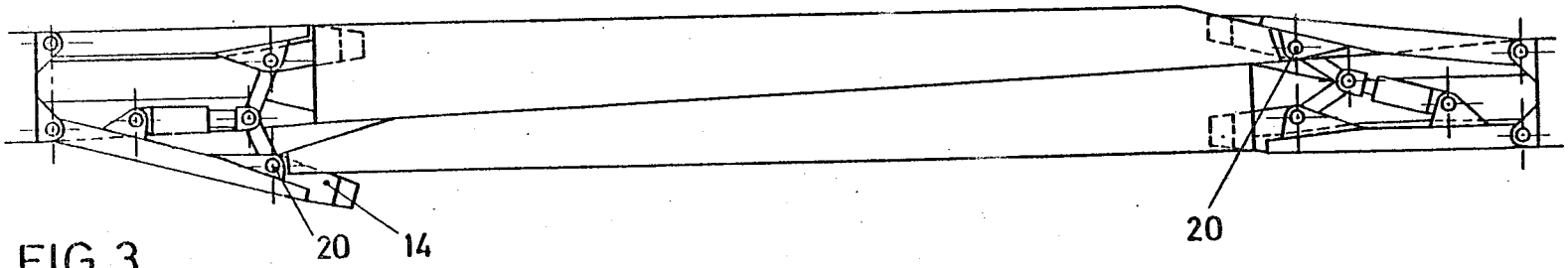
FIG. 3 shows, also in side view, another configuration of assembly of the two bridge elements according to the invention.

The method of assembling is as follows:

Two elements in accordance with the invention are arranged in such a way that the free ends which face each other overlap (overlap assembly). As the device is completely reversible, it is possible to obtain two symmetrical assemblies, as shown in FIGS. 2 and 3.

The method of assembly being the same for the two systems, it will be explained only with respect to FIG. 2, while the assembly of FIG. 3 will follow by way of symmetry. Furthermore, there will be indicated as 2A, 3A . . . and 3B, 4B . . . the parts of the bridge elements marked A and B.

The free end 21B of the element B is placed in position overlapping the end 21A of the element A. The bolts 16A of the intrados element A are then locked in the corresponding boreholes 17A and the bolts 18B of the extrados flap of the element B are locked in the corresponding boreholes 19B.

When the flaps 3A and 2B are locked, the jacks 6A and 6B are actuated, which has the effect of opening the flaps 2A and 3B.

End 21B is then engaged on end 21A until the centering pin 13A has struck against the bottom of the recess 15B while the yokes 20A and 20B position themselves opposite the bolts 16 and 18 respectively.

The bolts 16 and 18 are then locked by, for example, electric, electromagnetic, or hydraulic means 22, which firmly holds the two elements A and B together.

Instead of starting the assembly by the prior locking of the bolts 16A and 18B, it is also possible to first actuate the jacks 6A and 6B, which opens the intrados and extrados flaps by the same angle. The centering pins 13 may then be engaged in their recesses 14 which assures the positioning of the flaps 2 and 3 in such a manner that the locking means can then be actuated.

The invention as described has the advantage of causing the locking means to participate in the transmission of the forces at the main webs of the bridge elements and of permitting rapid assembly by means of standard elements which will be arranged, in accordance with the requirements, either in an upper position or in a lower position without any adaptation.

Furthermore, such a structure permits the construction of bridges of all lengths by the placing of several elements end to end, which elements may also be of different lengths since the only requirement for compatibility of the elements with each other resides in an equal length of their free end and in no way effects the length L of the central portion of the bridge element.

Such elements can therefore easily be applied to the bridging of gaps of all lengths.

We claim:

1. A device for permitting the lap joint connection of two bridge elements, said bridge elements being positionally interchangeable, ends of each bridge element comprising:

a first flap hinged on the extrados of the bridge element;

a second flap hinged on the intrados of the bridge element; and a means for the combined displacement in opposite directions of the first and second flaps; and means for locking at least one flap to its respective bridge element and means for locking at least one other flap to the other bridge element.

2. A device according to claim 1, wherein the first and second flaps are hinged to the bridge element at an equal distance from a front part of a free end of the bridge element, whereby the free end of each of the upper and lower bridge elements may be connected overlapping, with the extrados of one bridge element against the intrados of the other bridge element.

3. A device according to claim 2 wherein the means for the combined opposite displacement of the first and second flaps comprises:

a hydraulic jack whose body is fixed on an inner portion of either the first or second flap, said hydraulic jack having an arm which is articulated on a frontal part of each of the first and second flaps by means of two rods.

4. A device according to claim 3 wherein said locking means is formed on either bridge element, the locking means comprising at least one pair of locking bolts controlled electrically, electromagnetically or hydraulically, the locking means being hinged to each flap of the bridge element to which the locking means is attached, and the locking means being engageable with a plurality of corresponding yokes located on the bridge element to which the locking means is not attached, whereby the first and second flaps of the upper and lower bridge elements participate in transmission of forces between the upper and lower bridge elements.

5. A device according to claim 4, wherein the flaps of each element are so arranged that, when two elements are joined, the first and second flaps of the lower bridge element apply themselves respectively against the front part of the free end of the upper bridge element and against the intrados of the lower bridge element while the first and second flaps of the upper bridge element apply themselves against the extrados of the upper bridge element and against the front part of the free end of the lower bridge element.

6. A device according to claim 5 wherein the first and second flaps are provided on their front portion with a plurality of centering pins, the free ends of each bridge element the intrados and extrados surfaces of each bridge element facing the first and second flaps having a plurality of hollow recesses within which the centering pins of the first and second, flaps position themselves.

7. A device according to claim 6, wherein at least said first flap faces a hollow portion of its bridge element, said hollow portion being so formed that, at rest and in operation, the outer portions of said first flap falls within the profile of the surface of a roadway located on the bridge elements.

8. A process for the automatic lap connection of two bridge elements as defined in claim 7, comprising the steps of:

(a) opening the first and second flaps of an upper and a lower bridge elements;

(b) positioning the upper and lower bridge elements so that they overlap and so that the centering pins of the first flap of the lower bridge element come into position within the hollow recesses of the front part of the free end of the upper bridge element, while the centering pins of the second flap of the upper bridge element come into position within the hollow recesses of the front part of the free end of the lower bridge element; and (c) tightening the first and second flaps by means of said hydraulic jacks and actuating the locking bolts of each flap.

9. A device according to claim 4, wherein the flaps of each element are so arranged that when two elements are joined, the first and second flaps of the lower bridge element apply themselves respectively against the front part of the free end of the upper bridge element and against the intrados of the lower bridge element while the first and second flaps of the upper bridge element apply themselves against the extrados of the upper bridge element and against the front part of the free end of the lower bridge element.

10. A device according to claims 9, wherein the first and second flaps are provided on their front portion with a plurality of centering pins, the free ends of each bridge element and the intrados and extrados surfaces of each bridge element facing the first and second flaps having a plurality of hollow recesses within which the centering pins of the first and second flaps position themselves.

11. A device according to claim 10, wherein at least said first flap faces a hollow portion of its bridge element, said hollow portion being so formed that, at rest and in operation, the outer portion of said first flap falls within the profile of the surface of a roadway located on the bridge elements.

12. A device according to claim 4 wherein the first and second flaps are provided on their front portion with a plurality of centering pins, the free ends of each bridge element and the intrados and extrados surfaces of each bridge element facing the first and second flaps having a plurality of hollow recesses within which the centering pins of the first and second flaps position themselves.

13. A device according to claim 1, wherein at least said first flap faces a hollow portion of its bridge element, said hollow portion being so formed that, at rest and in operation, the outer portion of said first flap falls within the profile of the surface of a roadway located on the bridge elements.

14. A device according to claim 2 wherein the first and second flaps are provided on their front portion with a plurality of centering pins, the free ends of each bridge element and the intrados and extrados surfaces of each bridge element facing the first and second flaps having a plurality of hollow recesses within which the centering pins of the first and second flaps position themselves.

15. A device according to claim 2, wherein at least said first flap faces a hollow portion of its bridge element, said hollow portion being so formed that, at rest and in operation, the outer portion of said first flap falls within the profile of the surface of a roadway located on the bridge elements.

16. A device according to claim 4, wherein at least said first flap faces a hollow portion of its bridge element, said hollow portion being so formed that, at rest and in operation, the outer portion of said first flap falls within the profile of the surface of a roadway located on the bridge elements.

* * * * *